US010470640B2

(12) United States Patent
Ryu et al.

(10) Patent No.: US 10,470,640 B2
(45) Date of Patent: Nov. 12, 2019

(54) DISHWASHER AND METHOD FOR CONTROLLING THE SAME

(71) Applicant: SAMSUNG ELECTRONICS CO., LTD., Suwon-si, Gyeonggi-do (KR)

(72) Inventors: Jung Chan Ryu, Yongin-si (KR); Mi Ra Kim, Suwon-si (KR); Woo-Jin Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 22 days.

(21) Appl. No.: 15/639,286

(22) Filed: Jun. 30, 2017

(65) Prior Publication Data

US 2018/0000311 A1 Jan. 4, 2018

(30) Foreign Application Priority Data

Jun. 30, 2016 (KR) ..... 10-2016-0082966

(51) Int. Cl.
*A47L 15/00* (2006.01)
*A47L 15/22* (2006.01)
(Continued)

(52) U.S. Cl.
CPC ..... *A47L 15/0049* (2013.01); *A47L 15/0026* (2013.01); *A47L 15/0028* (2013.01);
(Continued)

(58) Field of Classification Search
CPC ..... A47L 15/0049; A47L 15/0026; A47L 15/0028; A47L 15/0034; A47L 15/22;
(Continued)

(56) References Cited

U.S. PATENT DOCUMENTS

2003/0084928 A1* 5/2003 Wood ..... A47L 15/0084 134/58 D
2010/0043250 A1 2/2010 Berends et al.
(Continued)

FOREIGN PATENT DOCUMENTS

EP 1543762 6/2005
EP 2371258 10/2011
(Continued)

OTHER PUBLICATIONS

Extended European Search Report dated Nov. 13, 2017 in European Patent Application No. 17177490.4.

*Primary Examiner* — Michael E Barr
*Assistant Examiner* — Tinsae B Ayalew
(74) *Attorney, Agent, or Firm* — Staas & Halsey LLP

(57) ABSTRACT

Disclosed herein is a dishwasher including a main body provided with an open hole and a washing tub; a door configured to open or close the open hole; a door opening/closing member configured to open or close the open hole; an air curtain disposed in the main body, to operate a fan such that ambient air is sucked and the sucked air is discharged; a detector configured to detect information of the fan; and a controller configured to diagnose the failure of the fan based on the detected information of the fan, to control an operation of the door opening/closing member such that the door is opened at a predetermined open time and an open time of the door is delayed when the fan is a failure state, and to control an operation of the fan when the fan is a normal state during a drying operation.

20 Claims, 17 Drawing Sheets

(51) Int. Cl.

| | |
|---|---|
| ***A47L 15/42*** | (2006.01) |
| ***A47L 15/46*** | (2006.01) |
| ***A47L 15/50*** | (2006.01) |
| ***A47L 15/48*** | (2006.01) |

(52) U.S. Cl.

CPC ..... *A47L 15/0034* (2013.01); *A47L 15/22* (2013.01); *A47L 15/4217* (2013.01); *A47L 15/4219* (2013.01); *A47L 15/4225* (2013.01); *A47L 15/4259* (2013.01); *A47L 15/4285* (2013.01); *A47L 15/4293* (2013.01); *A47L 15/46* (2013.01); *A47L 15/486* (2013.01); *A47L 15/502* (2013.01); *A47L 15/507* (2013.01); *A47L 2401/18* (2013.01); *A47L 2401/30* (2013.01); *A47L 2501/01* (2013.01); *A47L 2501/05* (2013.01); *A47L 2501/06* (2013.01); *A47L 2501/12* (2013.01); *A47L 2501/22* (2013.01)

(58) Field of Classification Search

CPC ..... A47L 15/4217; A47L 15/4219; A47L 15/4225; A47L 15/4259; A47L 15/4285; A47L 15/4293; A47L 15/46; A47L 15/486; A47L 15/502; A47L 15/507; A47L 2401/18; A47L 2401/30; A47L 2501/01; A47L 2501/05; A47L 2501/06; A47L 2501/12; A47L 2501/22

USPC ..... 134/56 D

See application file for complete search history.

(56) References Cited

U.S. PATENT DOCUMENTS

| | | | | |
|---|---|---|---|---|
| 2012/0124859 | A1* | 5/2012 | May | D06F 58/28 345/572 |
| 2012/0274259 | A1* | 11/2012 | Huang | F04D 27/001 318/490 |
| 2014/0170954 | A1* | 6/2014 | Hintz | A47L 15/48 454/251 |

FOREIGN PATENT DOCUMENTS

| | | | |
|---|---|---|---|
| JP | 2009247458 | A | 10/2009 |
| KR | 10-2007-0068190 | | 6/2007 |
| KR | 10-2016-0011439 | | 2/2016 |

* cited by examiner

DISHWASHER AND METHOD FOR CONTROLLING THE SAME

CROSS-REFERENCE TO RELATED APPLICATION

This application claims priority to and the benefit of Korean Patent Application No. 10-2016-0082966, filed on Jun. 30, 2016 in the Korean Intellectual Property Office, the disclosure of which is incorporated by reference in its entirety.

BACKGROUND

1. Technical Field

Embodiments of the present disclosure relate to a dishwasher which shortens the drying time and controls a water vapor discharge of a washing tub, and a method for controlling the same.

2. Description of the Related Art

In general, a dishwasher is an appliance for removing contaminants (remnants of food) attached to dishes through the spraying of cold or hot wash water under high pressure.

Certain dishwashers of this type include a wash tub, in which the washing of dishes is carried out, a plurality of baskets disposed in multiple stories to receive dishes, spray nozzles disposed at upper and lower portions of the wash tub, to spray wash water, and a pump connected to the spray nozzles, to pump wash water through the spray nozzles.

In such dishwasher, the dishwasher executes a wash operation and a rinsing operation by supplying an appropriate amount of water to the interior of the dishwasher and spraying the supplied water onto dishes through spray nozzles while circulating the water from the bottom side to the top side, and subsequently executes a drying operation to dry the washed dishes.

The drying method in the drying operation of the dishwasher is a method in which water remaining on the surface of tableware is evaporated by using a latent heat of the tableware, and a method in which the tableware is dried by spraying air heated by a separate heater.

Among the drying methods, the method using latent heat has a long drying time, and a method using the separate heater has a high energy consumption.

SUMMARY

Therefore, it is an aspect of the present disclosure to provide a dishwasher which delays the open time of a door during a drying operation when a fan of an air curtain is in a failure state, and a method for controlling the same.

It is another aspect of the present disclosure to provide a dishwasher which cancels the opening of a door during a drying operation when a fan of an air curtain is in a failure state, and a method for controlling the same.

It is another aspect of the present disclosure to provide a dishwasher which outputs failure information of a fan of an air curtain, and a method for controlling the same.

Additional aspects of the present disclosure will be set forth in part in the description which follows and, in part, will be obvious from the description, or may be learned by practice of the present disclosure.

In accordance with one aspect of the present disclosure, a dishwasher includes: a main body provided with an open hole and a washing tub; a door configured to open or close the open hole of the main body; a door opening/closing member configured to open or close the open hole by the door; an air curtain disposed in the main body, and configured to operate a fan such that ambient air is sucked and the sucked air is discharged; a detector configured to detect information of the fan; and a controller configured to diagnose a failure of the fan based on the detected information of the fan, and control, when the fan is a normal state during a drying operation, an operation of the door opening/closing member such that the door is opened at a predetermined open time, and an operation of the fan, and when the fan is a failure state, an operation of the door opening/closing member such that an open time of the door is delayed.

The controller may diagnose the failure of the fan at a time point before the predetermined open time.

The time point before the predetermined open time may include one of a time point which is a start time of the drying operation, a time point which is after the start time of the drying operation by a first time, a time point which is before the predetermined open time by a second time, and a time point which is before the start time of the drying operation by a third time.

The fan may include a motor. The controller may control driving of the motor for a predetermined time at a time point before the predetermined open time, and may diagnose the failure of the fan based on information detected by the detector while the motor is driving.

The detector may include a current detector to detect a current flowing through the motor. The controller may obtain a number of revolutions of the motor based on the detected current, and may diagnose the failure of the fan based on the obtained number of revolutions.

The detector may include one of a flow rate detector to detect a rate of flow of air around the fan, a pressure detector to detect the pressure around the fan, and a temperature detector to detect the temperature around the fan.

The controller may end the drying operation at a predetermined end time when the fan is in the normal state, and may delay an end time of the drying operation when the fan is in the failure state.

In accordance with one aspect of the present disclosure, the dishwasher may further include a display configured to output failure information of the fan and completion information of the drying operation.

The air curtain may include a flow path to flow air blown by the fan, wherein the flow path includes at least one discharge port provided adjacent to the door; and a guide member to guide the flow of air discharged to the outside through the at least one discharge port.

In accordance with another aspect of the present disclosure, a dishwasher includes a main body provided with an open hole and a washing tub; a door configured to open or close the open hole of the main body; a door opening/closing member configured to open or close the open hole by the door; an air curtain disposed in the main body, and configured to operate a fan such that ambient air is sucked and the sucked air is discharged; a detector configured to detect information of the fan; and a controller configured to diagnose the failure of the fan based on the detected information of the fan, to control an operation of the door opening/closing member such that the door is opened at a predetermined open time, to control an operation of the fan when the fan is a normal state during a drying operation, and to cancel an opening of the door when the fan is a failure state.

The controller may diagnose the failure of the fan at a time point before the predetermined open time.

The time point before the predetermined open time may include one of a time point which is a start time of the drying operation, a time point which is after the start time of the drying operation by a first time, a time point which is before the predetermined open time by a second time, and a time point which is before the start time of the drying operation by a third time.

The fan may include a motor. The controller may control driving of the motor for a predetermined time at a time point before the predetermined open time, and may diagnose the failure of the fan based on information detected by the detector while the motor is driving.

The controller may end the drying operation at a predetermined end time when the fan is in the normal state, and may delay an end time of the drying operation when the fan is in the failure state.

In accordance with another aspect of the present disclosure, the dishwasher may further include a display configured to output failure information of the fan and completion information of the drying operation.

In accordance with another aspect of the present disclosure, a method for controlling a dishwasher, includes: performing a washing operation, a rinsing operation, and a drying operation when a start command is received. The performing of the washing operation, the rinsing operation and the drying operation, includes: operating a fan when the present time point is a failure diagnosis time point of the fan of an air curtain; detecting information of the fan while the fan is operating; and diagnosing a failure of the fan based on the detected information. The performing of the drying operation includes: operating of the door opening/closing member such that the door is opened at a predetermined open time, and operating of the fan such that air flow is formed around the door when the fan is a normal state; and delaying an open time of the door and outputting failure information of the fan when the fan is a failure state.

The diagnosis of the failure of the fan may include: driving of a motor of the fan for a predetermined time at the failure diagnosis time point; and diagnosing the failure of the fan based on information detected by a detector while the motor is driving.

In accordance with another aspect of the present disclosure, the method for controlling the dishwasher, may further include: ending the drying operation at a predetermined end time when the fan is in the normal state; and delaying an end time of the drying operation when the fan is in the failure state.

In accordance with another aspect of the present disclosure, the method for controlling the dishwasher, may further include: detecting the temperature of the outside when the fan is in the failure state; and setting a delay time to delay the end time of the drying operation based on the detected temperature.

The failure diagnosis time point may include a time point before the predetermined open time.

BRIEF DESCRIPTION OF THE DRAWINGS

These and/or other aspects of the disclosure will become apparent and more readily appreciated from the following description of the embodiments, taken in conjunction with the accompanying drawings of which:

FIGS. 3A and 3B are views illustrating a door opening/closing member of the dishwasher in accordance with one embodiment of the present disclosure, of which FIG. 3A illustrates an operation of the door opening/closing member of the dishwasher when a door is opened and FIG. 3B illustrates an operation of the door opening/closing member of the dishwasher when a door is closed;

DETAILED DESCRIPTION

Figure 1:
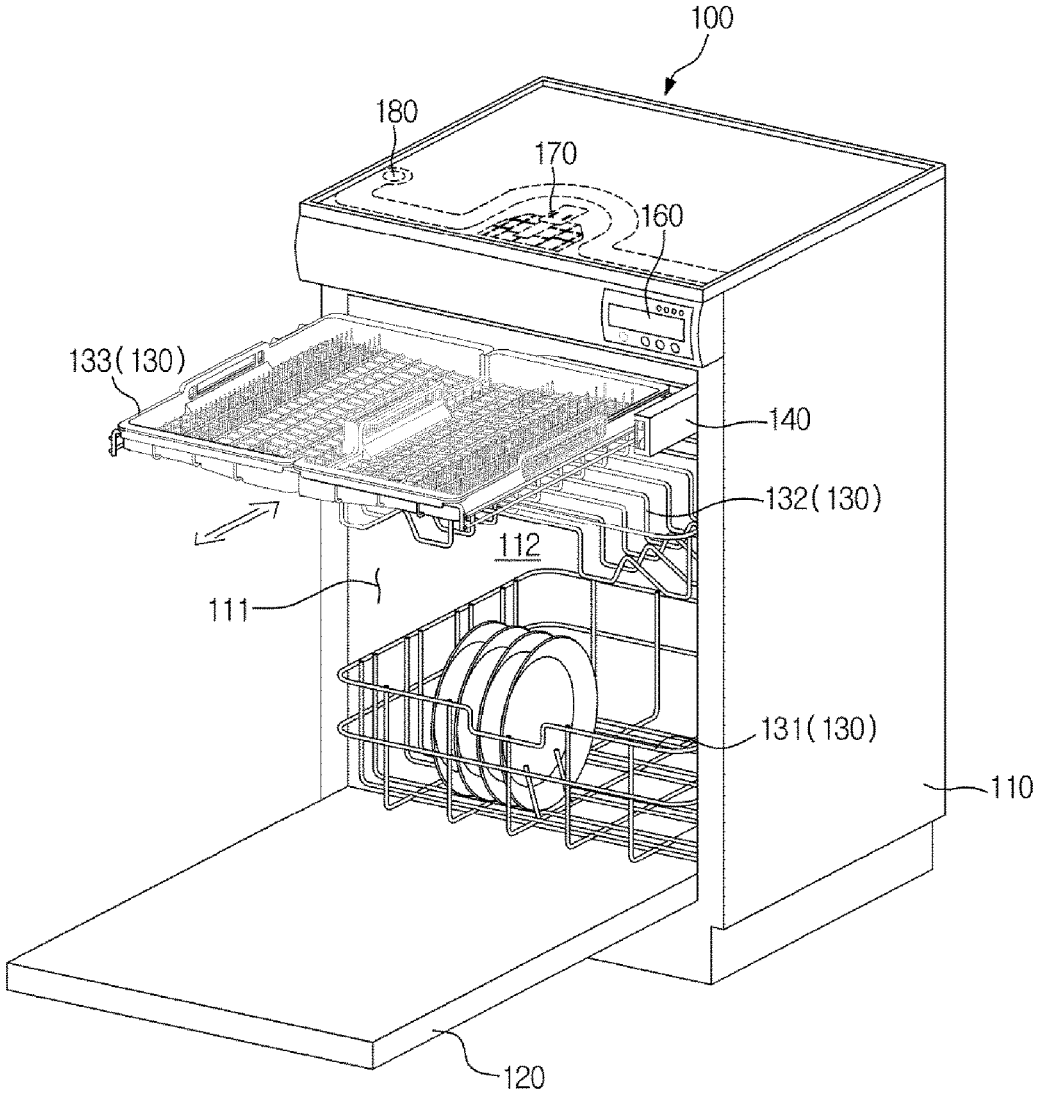
FIG. 1 is a perspective view of a dishwasher in accordance with one embodiment of the present disclosure.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

Figure 2:
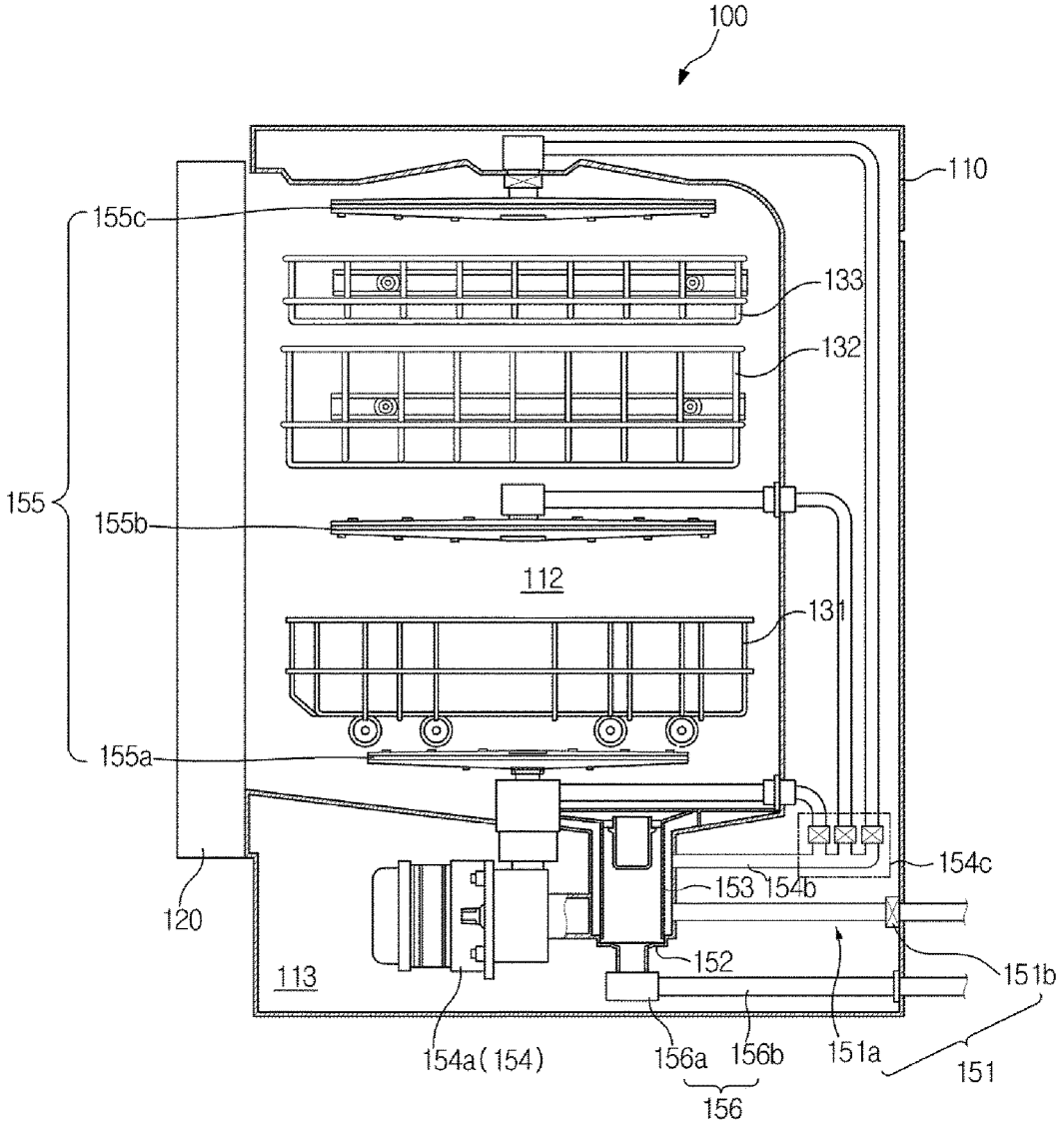
FIG. 2 is a view illustrating an internal structure of the dishwasher in accordance with one embodiment of the present disclosure.

FIG. 1 is a perspective view of a dishwasher in accordance with one embodiment of the present disclosure, and FIG. 2 is a view illustrating an internal structure of the dishwasher in accordance with one embodiment of the present disclosure. A dishwasher 100 includes a main body 110, a door 120, a receipt chamber 130, a sliding member 140, a washing assembly 150, and a user interface 160.

The main body 110 forms an external appearance of the dishwasher 100. The main body 110 is provided with an open hole on one surface thereof. A washing tub 112 opened and closed by the door 120, and a machinery chamber 113 formed by spatially separating from the washing tub 112 may be provided in the main body 110.

The door 120 is rotatably provided on the open hole of the main body 110 to open and close the open hole of the main body 110.

The door 120 may be coupled to a lower portion of the main body 110 by a hinge.

A handle or a handle groove for allowing a user to manually open the door 120 may be formed outside the door 120.

The receipt chamber 130 includes first and second baskets 131 and 132 and a cutlery basket 133 separated from each other in the washing tub 112, sliding forward and backward, accommodating tableware, and having holes of various sizes.

Here, the first basket 131 accommodates various kinds of tableware, such as bowls, dishes and cookware, the second basket 132 accommodates cups, and the cutlery basket 133 accommodates forks, table knives, spoons, chopsticks, kitchen knives and dippers.

The sliding member 140 is provided in the washing tub 112, respectively guides a movement of the first and second baskets 131 and 132 and the cutlery basket 133, and respectively slides the first and second baskets 131 and 132 and the cutlery basket 133.

The washing assembly 150 is disposed in the machinery chamber 113 and the washing tub 112 and executes a washing operation, rinsing operation, and drying operation for dishes.

The washing assembly 150 includes a water supplier 151, a sump 152, a heater 153, a circulator 154, a nozzle assembly 155, and a drainer 156.

The water supplier 151 is located between an external water supply source and the sump 152, and includes a water supply pipe 151*a* guiding water introduced from the outside to the sump 152, and a water supply valve 151*b* blocking the introduction of water from the outside.

The sump 152 stores water introduced through the water supply pipe 151*a*. Such water in which a detergent is dissolved serves as wash water, and wash water circulates through the washing tub 112, the sump 152, the circulator 154 and the nozzle assembly 155.

The heater 153 is located around the sump 152, and is operated to heat wash water in the sump 152.

The sump 152 may be provided with a temperature detector (not shown) detecting a temperature of wash water.

The circulator 154 is located between the sump 152 and the nozzle assembly 155, pumps wash water in the sump 152, and supplies wash water to the nozzle assembly through circulation pipes 154*b*.

The circulator 154 includes a circulation pump 154*a* pumping wash water in the sump 152, the circulation pipes 154*b* guiding the pumped wash water to the nozzle assembly 155, and valves 154*c* provided on the circulation pipes 154*b* and adjusting the circulation of the pumped wash water.

The nozzle assembly 155 jets wash water supplied through the circulator 154 toward various tableware accommodated on the first and second baskets 131 and 132 and the cutlery basket 133.

The nozzle assembly 155 includes a first nozzle 155*a* provided below the first basket 131, a second nozzle 155*b* provided between the first basket 131 and the second basket 132, and a third nozzle 155*c* provided above the cutlery basket 133.

The first nozzle 155*a*, the second nozzle 155*b* and the third nozzle 155*c* may be rotated by a rotor.

The drainer 156 outwardly drains water from the sump 152.

The drainer 156 includes a drainage pump 156*a* to pump water from the sump 152, and a drainage tube 156*b* to outwardly guide the water pumped by the drainage pump 156*a*. The drainer 156 may further include a drain valve (not shown) adjusting the discharge of wash water in the sump 152 to the outside.

The user interface 160 is provided at the main body 110, for manipulation and display of information as to the operation of the dishwasher 100.

The user interface 160 receives operation information, such as various washing courses (for example, a standard course, a manual course, etc.) and addition of rinsing, through user's instructions, and displays operation information in progress and error information when an error occurs.

Here, the washing course includes a washing operation of washing tableware by jetting wash water to the tableware, a rinsing operation of rinsing the tableware by jetting rinse water to the tableware, and a drying operation of drying the tableware having undergone the rinsing operation.

The dishwasher further includes a door opening/closing member 170 and an air curtain 180.

The door opening/closing member 170 is arranged in an interior space of the main body 110. The door opening/closing member 170 may be provided in a space between an upper portion of the washing tub 112 and the main body, and may be in contact with one side of the door 120.

The one side of the door may be a portion facing a portion of the main body to which the hinge is coupled.

The door opening/closing member 170 detaches the door coupled to the main body from the main body.

That is, the door opening/closing member 170 allows the door to be automatically opened. The door may be manually closed by the user's force.

The door opening/closing member 170 may be coupled with the one side of the door 120 when the one side of the door 120 is in contact. At this time, the door opening/closing member 170 allows the door 120 to be automatically coupled with or separated from the main body.

The door opening/closing member 170 in accordance with one embodiment automatically opens the door 120 to allow water vapor of the interior of the main body to be discharged to the outside during the drying operation.

That is, the door opening/closing member 170 opens the door 120 by a predetermined angle before the drying operation is completed.

Herein, before the drying operation is completed, a predetermined time may include a time point which is after a start time of the drying operation. Before the drying operation is completed, a predetermined time may include a time point which is before an end time of the drying operation.

Structures of the door opening/closing member will be described in more detail by way of examples.

Figure 3A:
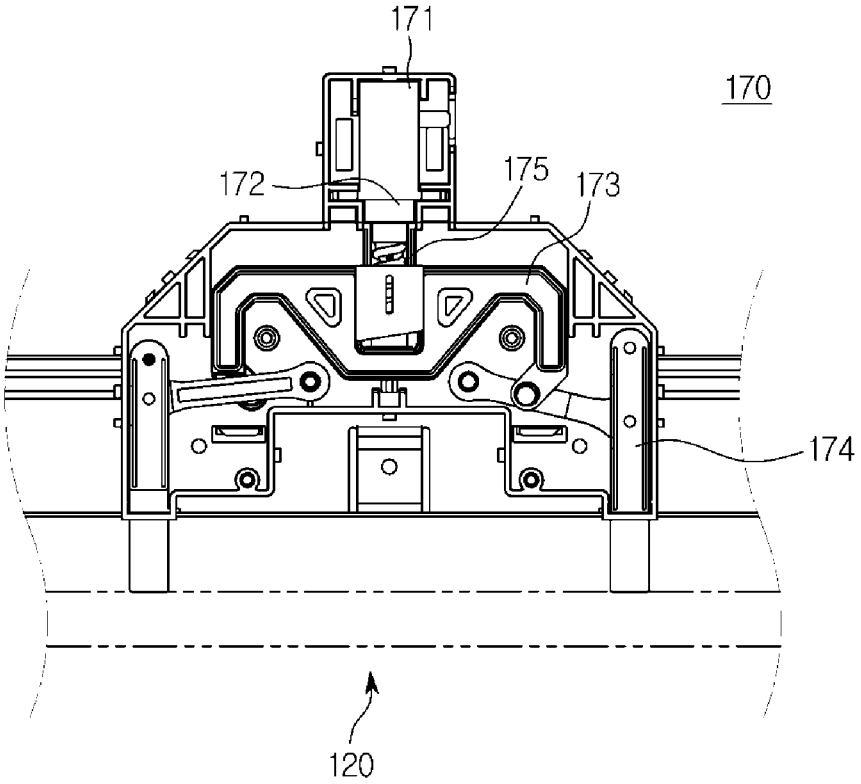
Figure 3B:
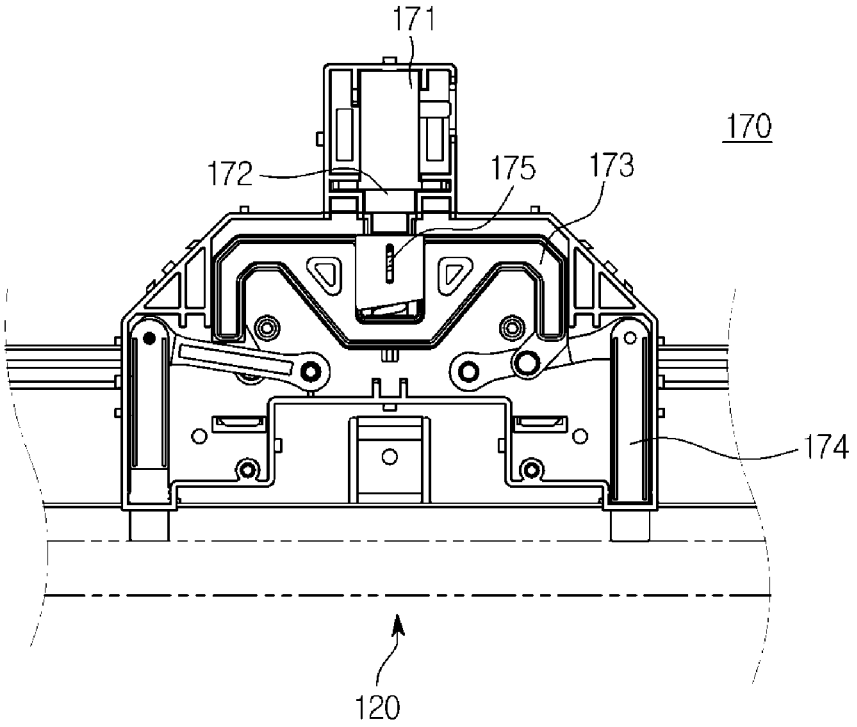

FIGS. 3A and 3B are views illustrating a door opening/closing member of the dishwasher in accordance with one embodiment of the present disclosure, of which FIG.3A illustrates an operation of the door opening/closing member of the dishwasher when a door is opened and FIG. 3B illustrates an operation of the door opening/closing member of the dishwasher when a door is closed.

Particularly, FIG. 3A is a view illustrating an operation of the door opening/closing member of the dishwasher when a door is opened, and FIG. 3B is a view illustrating an operation of the door opening/closing member of the dishwasher when a door is closed.

The door opening/closing member 170 may include an actuator 171 to generate heat, a plunger 172 to protrude by a predetermined distance at the time of thermal expansion and to return to the original position at the time of thermal contraction, a movable member 173 to receive power from the plunger 172 and to move back and forth linearly by using the received power, a push member 174 to receive a moving force from the movable member 173, to push the door by using the received moving force and to open the washing tub 112 by pushing the door 120, and an elastic member 175 to slowly press the movable member 173 by buffering a stroke caused by the moving force transmitted to the movable member 173 when the plunger 172 is driven.

The plunger 172 returns to the original position by the occurrence of the thermal contraction as the time elapses. Accordingly, the movable member and the push member move in the direction opposite to the advancing direction at the time of opening the door, so that they can all return to the home position.

Accordingly, the movable member 173 and the push member 174 may return to the original position by moving in a direction opposite to a direction of movement of when the door is opened.

The air curtain 180 may be provided in the interior space of the main body 110, may be provided in the space between the upper portion of the washing tub 112 and the main body 110, and may be provided adjacent to the door opening/closing member 170.

The air curtain 180 sucks ambient air when high temperature and high humidity air inside the washing tub is discharged to the outside by the opening of the door during the drying operation. The air curtain 180 discharges the sucked air to the outside of the door. At this time, the air curtain 180 discharges the sucked air in a predetermined direction. Accordingly, the air curtain can lower the temperature and humidity of the air discharged from the washing tub 112.

The air curtain 180 can change a flow of water vapor raised by a convection phenomenon by forming the air curtain around the door, thereby preventing high temperature and high humidity air from contacting the furniture around the dishwasher.

The air curtain 180 will be described in more detail with reference to FIGS. 4, 5 and 6.

Figure 4:
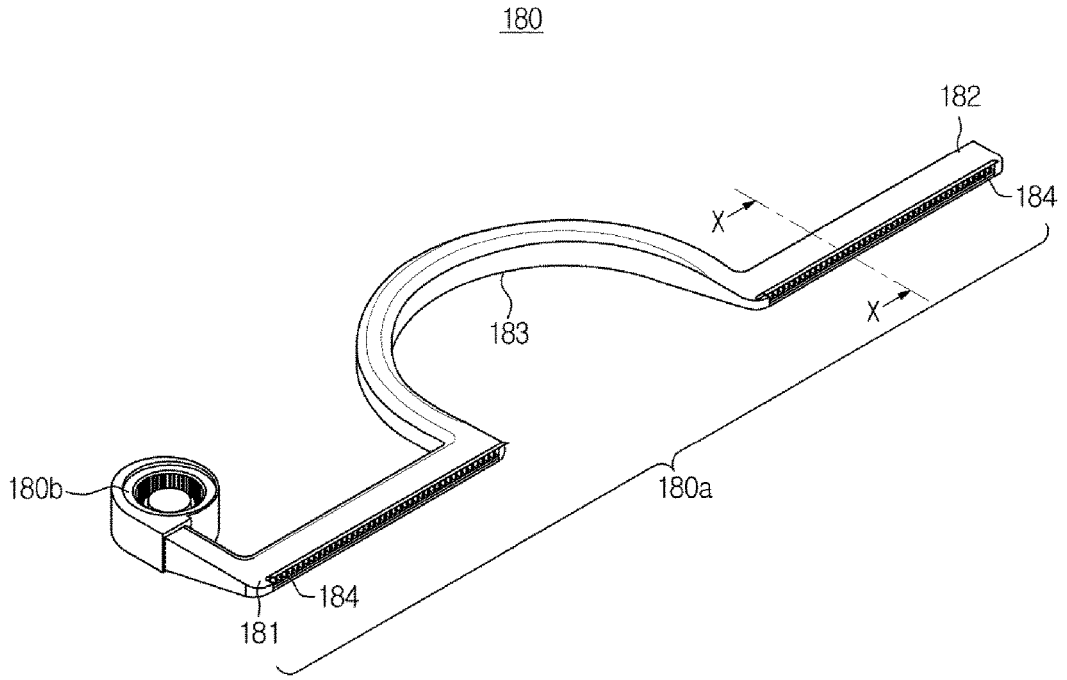
FIG. 4 is a view illustrating an air curtain of the dishwasher in accordance with one embodiment of the present disclosure.
Figure 5:
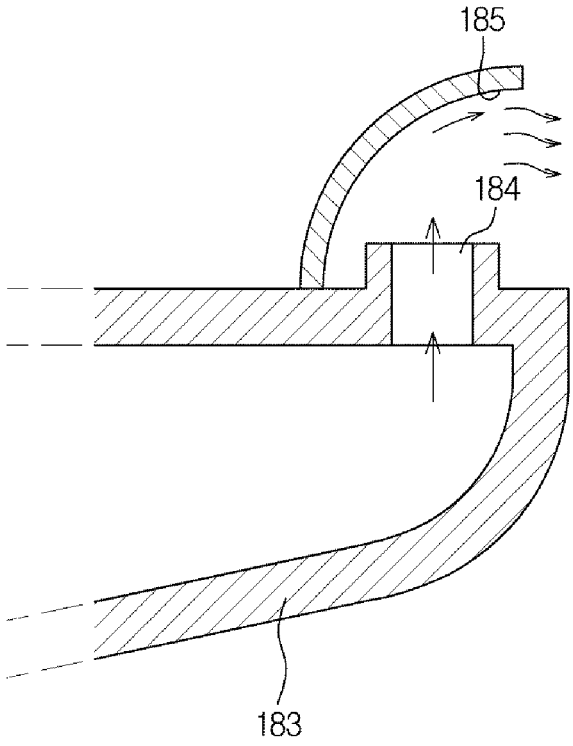
FIG. 5 is a sectional view illustrating a second flow path (x-x) of the air curtain of the dishwasher according to the embodiment of FIG. 4.
Figure 6:
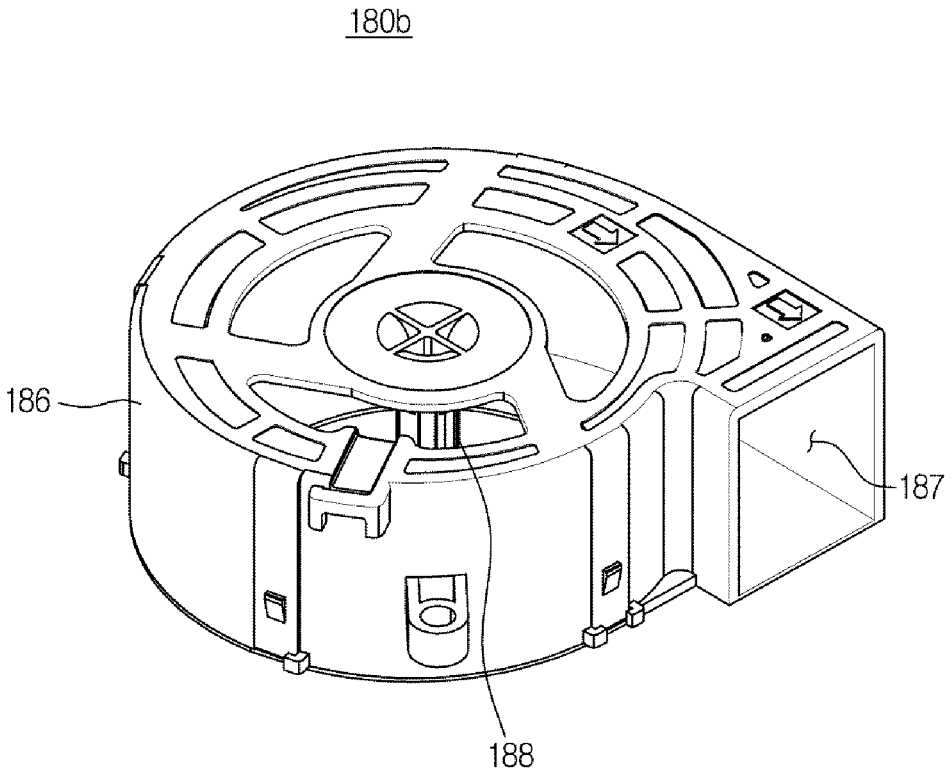
FIG. 6 is a view illustrating a blower of the air curtain according to the embodiment of FIG. 4.

FIG. 4 is a view illustrating an air curtain of the dishwasher in accordance with one embodiment of the present disclosure, FIG. 5 is a sectional view illustrating a second flow path (x-x) of the air curtain of the dishwasher according to the embodiment of FIG. 4, and FIG. 6 is a view illustrating a blower of the air curtain according to the embodiment of FIG. 4.

Referring to FIG. 4, the air curtain 180 includes a duct 180*a* forming a flow path and a blower 180*b* provided adjacent to the duct 180*a*, and to provide fluidity to an air in the duct 180*a*.

The flow path of the duct 180*a* includes a first flow path 181 provided adjacent to one side of the front of the main body 110, a second flow path 182 provided adjacent to the other side of the front of the main body 110, and a third flow path 183 to connect the first flow path 181 and the second flow path 182. The third flow path 183 is provided in a semicircular shape or a curved shape.

Referring to FIG. 5, the first flow path 181 and the second flow path 182 includes a plurality of discharge ports 184 provided on the front of the dishwasher 100, that is, on a side where the door is provided and to allow water vapor in the washing tub 112 to flow toward the front of the dishwasher 100, and a guide member 185 provided adjacent to the discharge port 184, and to guide the flow of air.

The plurality of discharge ports 184 may discharge air inside of the duct to the outside. That is, the dishwasher 100 may form an air jet through the plurality of discharge ports 184.

The door opening/closing member 170 may be disposed inside the third flow path 183 provided in a semicircular shape or a curved shape.

The cross-sectional area of the connecting portion connected to the first flow path and the second flow path of the third flow path 183 may be smaller than the cross-sectional area of the remaining portion except for the connecting portion of the third flow path 183. Accordingly, the flow velocity of the air flowing from the first flow path to the third flow path can be reduced, and the flow velocity of the flow of the air flowing from the third flow path to the second flow path can be increased.

Accordingly, the air curtain 180 can minimize a deviation of air discharged through the plurality of discharge ports 184 formed in the first flow path 181 and the second flow path 182 by providing a uniform flow of air to the first flow path 181 and the second flow path 182 by the third flow path 183.

The third flow path 183 has a structure capable of minimizing a flow rate deviation of the air flowing through the first flow path 181 and the second flow path 182 without interfering with the door opening/closing member 170.

The blower 180*b* is provided adjacent to the first flow path 181 of the duct and sucks the ambient air and supplies the sucked air to the first flow path 181. That is, the blower 180*b* regulates the flow of air in the duct 180*a*.

Referring to FIG. 6, the blower 180*b* includes a housing 186 to form an exterior of the blower 180*b*, a blowing hole 187 formed in the blower 180*b* and coupled to an inlet of the first flow path 181 of the duct 180*a,* and a fan 188 to suck the ambient air and to blow the sucked air.

The blower 180*b* may further include a motor 189 coupled to a shaft of the fan 188 and apply a rotational force to the fan 188.

The motor 189 may be a direct current (DC) motor. The motor 189 may be an alternation current (AC) motor.

The fan 188 may be a centrifugal fan to supply the air introduced from the outside to the duct 180*a.*

If the fan 188 is a centrifugal fan, the centrifugal fan is possible to suck the ambient air and supply the sucked air to the duct 180*a.* Also, the centrifugal fan may suck the high temperature and high humidity air in the washing tub 112 together and may discharge the sucked air.

The fan 188 effectively supplies air to the inside of the duct 180*a,* thereby maintaining a predetermined flow rate of air.

The fan 188 may include an axial flow fan. The fan 188 may include a cross flow fan. The blower 180*b* can flow air to the duct 180*a* by using the axial flow fan or the cross flow fan.

Figure 7:
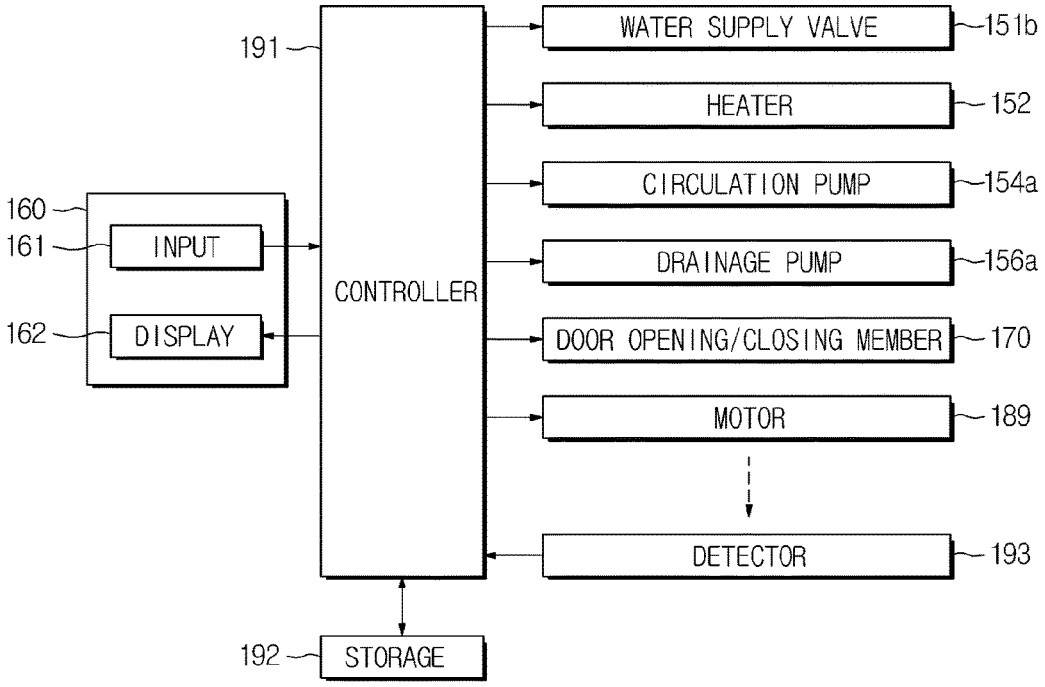
FIG. 7 is a block diagram illustrating the dishwasher in accordance with one embodiment of the present disclosure.

FIG. 7 is a block diagram illustrating the dishwasher in accordance with one embodiment of the present disclosure.

The dishwasher includes a washing assembly 150, the user interface 160, the door opening/closing member 170, the air curtain 180, a drive module 190, and a detector 193.

The washing assembly 150 may include the water supply valve 151*b,* the heater 153, the circulation pump 154*a* and the drainage pump 156*a,* which are operated based on a command of the drive module.

The user interface 160 may include an input 161 to receive a start command, an end command and the washing course input by the user in association with the washing of dishes, and a display 162 to display operation information of the dishwasher and error information of the dishwasher, etc.

Here, the washing course may include a plurality of courses having different combinations of washing time, number of times of rinsing, rinsing time, drying time, and the like.

The input 161 may receive the washing time, the number of times of rinsing, the rinsing time, and the drying time directly input by the user.

The input 161 may be provided as a touch panel or a button type. The display 162 may be provided as at least one of a flat panel display and a light emitting diode.

The error information may include an error code, handling information corresponding to the error, and the like.

For example, the display 162 may display a fault code of the motor 189 of the air curtain.

The display 162 may display handling information corresponding to a failure of the motor 189 of the air curtain, and may display extension notification information of the end time of the drying operation due to the failure of the motor.

The dishwasher may further include a sound output device (not shown).

The sound output device may output alarm information corresponding to the failure of the motor 189 of the air curtain as a sound.

The door opening/closing member 170 actuates the actuator based on the command of the drive module 190 during the drying operation so that the door 120 is kept in a closed state or the door 120 is changed to an open state.

The door opening/closing member 170 may automatically open the door 120 when a door opening command is input to the input 161, and may automatically close the door 120 when a door closing command is input to the input 161.

The dishwasher may further include a door opening/closing button provided on the input 161, and may further include a door opening switch provided on the handle.

The door opening/closing member 170 may allow the door to be manually opened or closed by a force of the user acting on the door. At this time, the door opening/closing member 170 of the dishwasher may allow a coupling structure (not shown) with the door 120 to be separated from the door when the user's force is applied to the handle of the door 120.

The air curtain 180 allows an air flow to be formed around the door 120 by operating the fan 188 on the blower based on the command of the drive module 190 during a drying operation.

The drive module 190 may include a controller 191 to check the washing course input to the input 161, to check operation information of the checked washing course and to control an operation of the water supply valve 151*b* of the washing assembly 150, an operation of the heater 153, an operation of the circulation pump 154*a,* an operation of the drainage pump 156*a,* an operation of the door opening/closing member 170 and an operation of the air curtain 180 based on the checked operation information, and a storage 192 to store various information for controlling an operation of the dishwasher.

The controller 191 and the storage 192 may be provided integrally or separately.

The controller 191 diagnoses a failure of the fan 188 of the air curtain at a preset time, and adjusts an open/close time of the door and an end time of the drying operation during the drying operation based on diagnosis information.

Particularly, the controller 191 controls driving of the motor so that the air flow is formed around the door, controls the operation of the door opening/closing member 170 so that the door is opened at a predetermined first open time, controls the operation of the drainage pump 156*a* so that water inside the washing tub is discharged to the outside, and allows the drying operation to end at a predetermined first end time when the fan 188 of the air curtain is in a normal state.

The controller 191 controls the operation of the door opening/closing member 170 so that the door is opened at a predetermined second open time, controls the operation of the drainage pump 156*a* so that water inside the washing tub is discharged to the outside, and allows the drying operation to end at a predetermined second end time when the fan 188 of the air curtain is in a failure state.

The failure of the fan 188 of the air curtain includes a failure of the motor 189 to rotate the fan 188.

That is, the controller 191 compares information of the motor detected by the detector 193 with reference information, and diagnoses the failure of the motor based on the compared information.

The detected motor information may include current of the motor, voltage of the motor, number of revolutions of the motor or pulses of the motor.

The number of revolutions of the motor may be indirectly detected by detecting the current of the motor, or directly detected using a physical detector connected to the motor.

The controller 191 may diagnose the failure of the motor 189 by comparing environmental information detected by the detector 193 with reference environmental information.

The detected environmental information may include the pressure, temperature, or rate of flow of air in the housing of the blower.

The storage 192 stores the predetermined first open time and the predetermined second open time for opening the door, and stores the predetermined first end time and the predetermined second end time for ending the drying operation.

The predetermined second open time is a time delayed in the predetermined first open time. A time between the start time of the drying operation and the predetermined second open time is longer than a time between the start time of the drying operation and the predetermined first open time.

The predetermined second end time is longer than a time from the start time of the drying operation to the predetermined first end time.

The dishwasher may further include an outside air detector (not shown) to detect the temperature of the outside air. At this time, the controller 191 may adjust the predetermined second open time and the predetermined second end time based on the detected temperature of the outside air.

The storage 192 may store the operation information of the washing operation, the rinsing operation and the drying operation corresponding to the plurality of laundry courses, respectively.

The storage 192 may store information of a failure diagnosis time point to diagnose the failure of the motor 189 provided in the blower 180*b*.

The information of the failure diagnosis time point includes a time point before the open time of the door during the drying operation.

The storage 192 may store the reference information to diagnose the failure of the motor.

The reference information may include one of a reference current, a reference voltage, a reference number of revolutions, a reference flow rate, a reference pressure, and a reference temperature.

The detector 193 detects the information of the motor to detect the failure of the motor 189 provided in the blower 180*b* and transmits the detected information to the controller 191.

The detector 193 may be one of a current detector to detect a current flowing through the motor 189, a revolution detector to detect the number of revolutions of the motor 189, and a pulse detector.

The detector 193 is provided inside the housing of the blower. The detector 193 may detect the environmental information of around the motor, that is, the inside of the housing, in order to detect the failure of the motor 189.

For example, the detector 193 includes one of a temperature detector to detect the temperature inside the housing of the blower, a pressure detector to detect the pressure inside the housing of the blower, a flow rate detector to detect the rate of flow of air in the housing of the blower.

The drive module 190 may further include a motor driver 190*a* to rotate the motor 189 of the air curtain. At this time, the motor driver 190*a* may be provided separately from the controller 191 and may be driven by the command of the controller 191.

If the detector is a current detector, the current detector may include a hall sensor H, which may be provided in the motor driver 190*a*.

An example of the motor driver 190*a* will be described in more detail with reference to FIG. 8.

Figure 8:
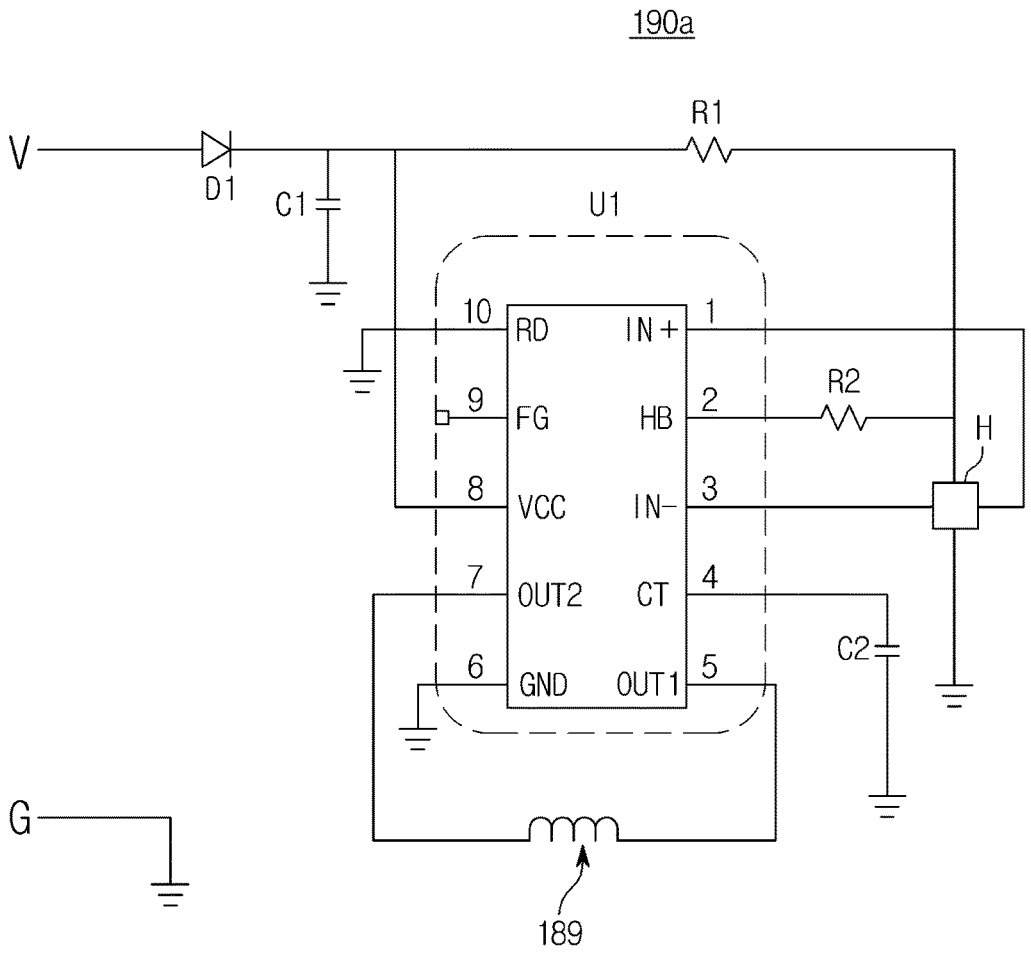
FIG. 8 is a block diagram illustrating a motor driver of the dishwasher in accordance with one embodiment of the present disclosure.

Referring to FIG. 8, the motor driver 190*a* includes a diode D1 connected to a power supply terminal V, and a first capacitor C1 connected between a cathode terminal of the diode D1 and a ground G, an integrated circuit (IC) U1 connected to the cathode terminal of the diode D1, a first resistor R1 connected to the cathode terminal of the diode D1, the hall sensor H connected to the first resistor R1 and the integrated circuit U1, a second capacitor C2 connected to the integrated circuit U1, and a second resistor R2 connected between the hall sensor H and the integrated circuit U1.

The motor 189 may be connected between two output terminals of the integrated circuit U1.

Hereinafter, the operation of the motor driver 190*a* will be briefly described.

When a current is applied to an input terminal of the hall sensor H, a potential difference of the magnetic field is generated between an N pole and an S pole of a magnet of the hall sensor. At this time, a potential difference corresponding to high signal and low signal is generated at a output terminal of the hall sensor H based on the generated potential difference of the magnetic field.

The potential difference corresponding to high signal and low signal is proportional to a current applied to the hall sensor H and a magnetic flux density.

The integrated circuit U1 may output a digital signal by turning on or turning off a plurality of internal transistors based on the input signal when the high and low signals corresponding to the potential difference of the magnetic field are inputted from the hall sensor H. At this time, the motor 189 rotates by alternately changing a direction of the current flowing in a coil of the motor 189 based on the digital signal outputted.

The controller 191 may detect the current flowing in the motor 189 based on on/off operation information of a plurality of transistors in the motor driver 190*a*, and may diagnose the failure of the motor 189 by comparing the detected current with the reference current.

The controller 191 may obtain the number of revolutions of the motor based on the detected current, and may diagnose the failure of the motor by comparing the obtained number of revolutions of the motor with the reference number of revolutions.

The controller 191 may adjust the current of the motor 189 and the voltage of the motor 189 based on the obtained number of revolutions so that the motor 189 is rotated at a target number of revolutions when the fan is in the normal state.

Figure 9:
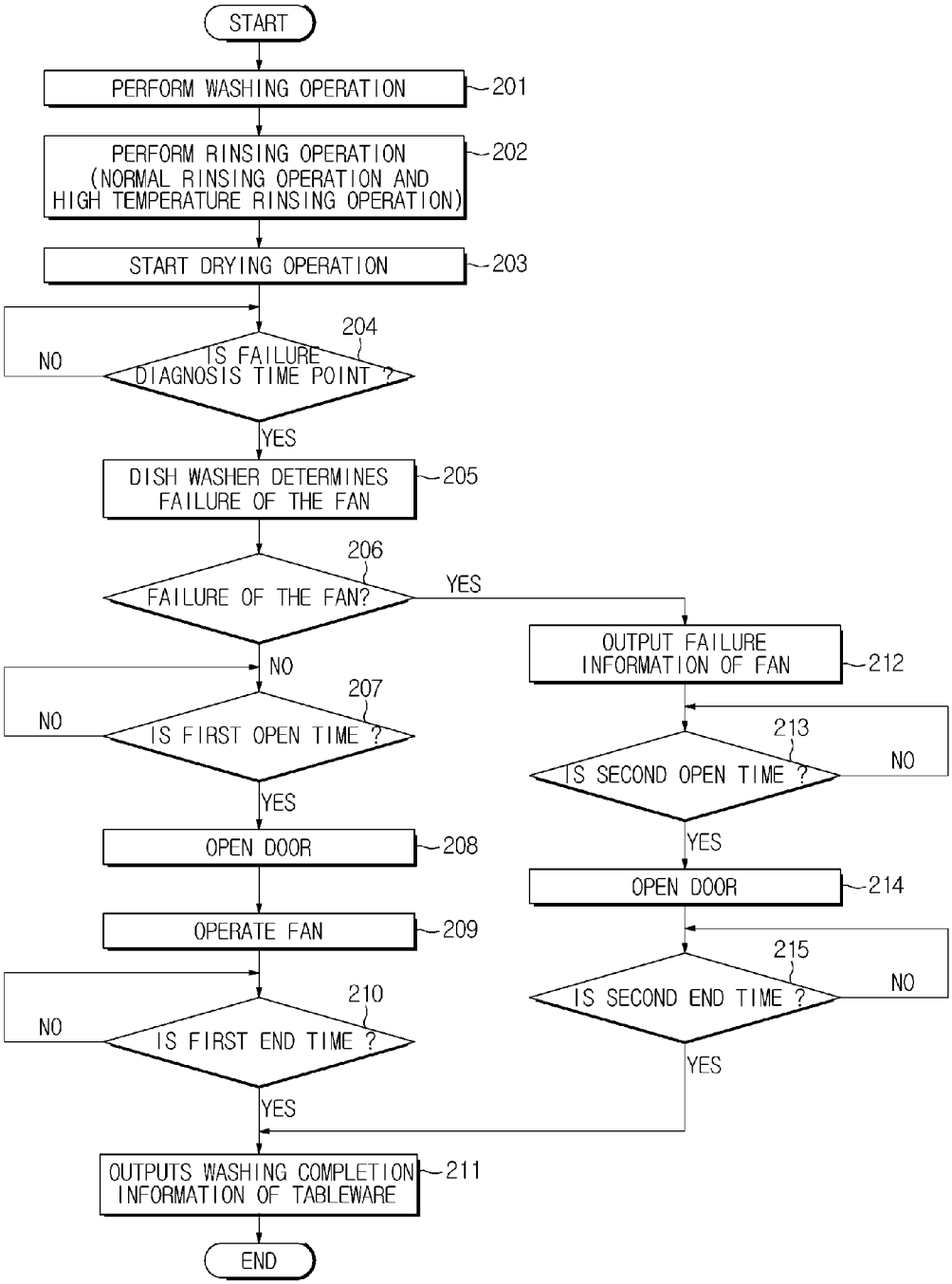
FIG. 9 is a flowchart illustrating a method for controlling the dishwasher in accordance with one embodiment of the present disclosure.

FIG. 9 is a flowchart illustrating a method for controlling the dishwasher in accordance with one embodiment of the present disclosure. This will be described in more detail with reference to FIGS. 10, 11 and 12.

The dishwasher receives an external power and performs a standby mode when a power on command is input.

The dishwasher cancels the standby mode and checks operation information corresponding to the inputted washing course when the washing course and the start command are inputted to the input 161.

Herein, the operation information includes washing information such as the temperature of the wash water and the washing time in the washing operation, rinsing information such as the temperature of the rinse water, the rinsing time and the number of times of rinsing in the rinsing operation, and drying information such as the drying time in the drying operation.

The dishwasher may receive the washing time of the washing operation, the number of times of rinsing of the rinsing operation, the drying time of the drying operation, and the like directly input by the user through the input 161.

The dishwasher performs the washing, rinsing and drying operations in sequence based on the washing time, the number of times of rinsing, and the drying time.

Particularly, the operation information of the dishwasher to perform latent heat drying will be described as an example.

Figure 10:
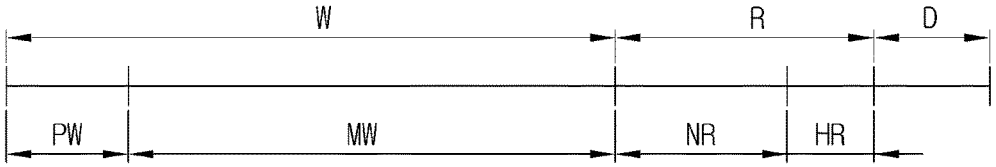
FIG. 10 is a view illustrating an operation procedure of the dishwasher in accordance with the embodiment of the present disclosure.

Referring to FIG. 10, the dishwasher includes a washing operation W to receive wash water, to circulate and spray the wash water, to wash the tableware by circuiting and spraying the wash water, to discharge the wash water to the outside when the washing time elapses, a rinsing operation R to receive rinse water, to circulate and spray the rinse water, to rinse the tableware by circuiting and spraying the rinse water, to discharge the rinse water to the outside when the rinsing operation is completed, a drying operation D to dry the rinsed tableware, and to discharge the water (condensed water) generated in the drying operation to the outside when the drying time elapses.

The washing operation W may include a preliminary washing operation PW to perform a preliminary washing of the tableware during a preliminary washing time, and a main washing operation MW to perform washing of the tableware for a time longer than the preliminary washing time.

The rinsing operation R includes a normal rinsing operation NR to rinse the tableware by the selected number of times of rinsing using the rinse water of the predetermined rinsing temperature, and a high temperature rinsing operation HR to rinse the tableware with the rinse water of a target temperature higher than the predetermined rinsing temperature.

A rinsing time of the high temperature rinsing operation may be shorter than a rinsing time of the normal rinsing operation.

That is, the dishwasher performs a washing operation (201) by controlling the water supply valve 151*b*, the heater 153, the circulation pump 154*a* and the drainage pump 156*a*. When the washing operation is completed, the dishwasher performs the normal rinsing operation of the rinsing operation by controlling the water supply valve 151*b*, the heater 153, the circulation pump 154*a* and the drainage pump 156*a*.

When the normal rinsing operation is completed, the dishwasher performs the high temperature rinsing operation (202). That is, the dishwasher receives the rinse water, controls the operation of the heater so that the temperature of the rinse water is reached to the target temperature, and controls the operation of the circulation pump 154*a* so that the heated high-temperature rinse water is sprayed to the tableware.

When the high temperature rinsing operation is completed, the dishwasher starts the drying operation (203). The dishwasher determines whether the present time point is the failure diagnosis time point of the fan (204), and diagnoses the failure of the fan (205) upon determining that the present time point is the failure diagnosis time point.

Herein, the failure diagnosis time point of the fan includes one of a time between the start time of the drying operation and the time before the open time of the door.

Figure 11:
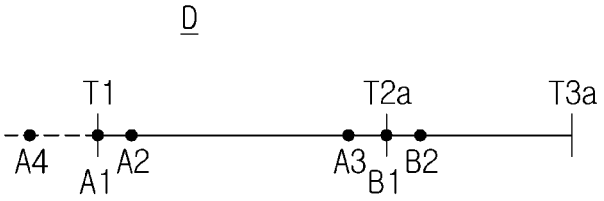
FIG. 11 is a view illustrating a drying operation of the dishwasher in accordance with the embodiment of the present disclosure.

Referring to FIG. 11, the time information of the drying operation for drying the tableware may include a start time T1 at which the drying operation starts, a first open time T2*a* at which the door is opened, and an end time T3*a* of the drying operation.

The failure diagnosis time point of the fan includes one of a time point A1 which is the start time T1 of the drying operation, a time point A2 which is after the start time T1 of a drying operation by a predetermined first time, and a time point A3 which is before the first open time T2*a* by a predetermined second time.

The present disclosure describes embodiments to diagnose the failure of the fan at a time after the start time of the drying operation. The embodiments may diagnose the failure of the fan at a time point A4 which is before the start time of the drying operation by a predetermined third time.

The failure diagnosis time point of the fan includes a time point during the washing operation or a time point during the rinsing operation.

That is, the dishwasher may diagnose the failure of the fan at a time point prior to the predetermined first open time during the drying operation.

The failure diagnosis of the fan includes detecting the motor information of the motor that applies the rotational force to the fan 188 upon determining that the present time point is the failure diagnosis time point, and diagnosing the failure of the fan based on the detected motor information and the reference information.

The failure diagnosis of the fan may include detecting the environmental information of the fan 188 upon determining that the present time point is the failure diagnosis time point, and diagnosing the failure of the fan based on the detected environmental information and the reference information.

The motor information includes information corresponding to at least one of the current of the motor, the voltage of the motor, the number of revolutions of the motor and the pulses of the motor. The environmental information may include information corresponding to at least one of the pressure around the fan, the temperature and the rate of flow of air.

The reference information may include one of a reference current, a reference voltage, a reference number of revolutions, a reference flow rate, a reference pressure, and a reference temperature.

Of these, an example of detecting the current flowing to the motor 189 when the present time point is a time point which is after the start time of the drying operation by a first time, obtaining the number of revolutions corresponding to the detected current, comparing the obtained number of revolutions and the reference number of revolutions, and diagnosing the malfunction of the motor based on the compared number of revolutions will be described.

Figure 12:
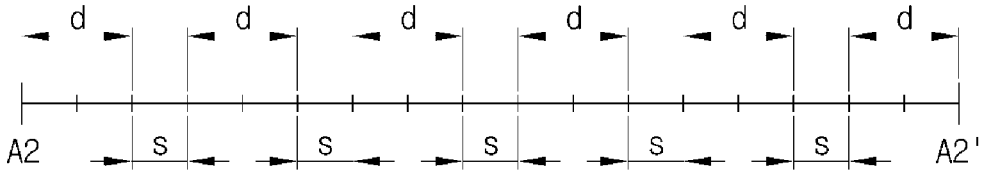
FIG. 12 is a view illustrating a failure diagnosis of the dishwasher in accordance with the embodiment of the present disclosure.

Referring to FIG. 12, when the present time point is a time point which is after the start time of the drying operation by the first time, the dishwasher rotates the motor for a predetermined detection time, and detects the current flowing to the motor 189. When the predetermined detection time elapses, the dishwasher stops the rotation of the motor, and obtains the number of revolutions corresponding to the detected current.

The dishwasher compares the obtained number of revolutions and the reference number of revolutions, and determines whether the obtained number of revolutions is higher than or equal to the reference number of revolutions. The dishwasher determines that the fan is in the normal state when it is determined that the obtained number of revolutions is higher than or equal to the reference number of revolutions, and ends the diagnosis of the failure of the fan.

The dishwasher primarily determines that the fan is in the failure state when it determined that the obtained number of revolutions is lower than the reference number of revolutions. When a predetermined stop time (s) elapses, the dishwasher rotates the motor for a predetermined detection time (d). When the predetermined detection time elapses, the dishwasher stops the rotation of the motor, and re-obtains the number of revolutions corresponding to the detected current.

The dishwasher compares the re-obtained number of revolutions and the reference number of revolutions, and determines whether the re-obtained number of revolutions is higher than or equal to the reference number of revolutions. The dishwasher secondarily determines that the fan is in the failure state when it is determined that the re-obtained number of revolutions is lower than the reference number of revolutions.

The dishwasher repeats the failure diagnosis of the fan by the above method, and finally determines that the fan is in the failure state when a number of failure diagnoses diagnosed by fan failure reaches a predetermined number of failure diagnoses.

The dishwasher diagnoses the failure of the fan by the predetermined number of failure diagnoses from the time point A2 to a detection end time A2'.

The time point A2 is a time point which is after the start time of the drying operation by the first time. The detection end time A2' is a time point which is after the time point A2 by a preset time.

The dishwasher diagnoses the failure of the fan by a predetermined number of times until the detection end time (A2') after a lapse of a first time from the start time of the drying operation (A2) to a predetermined time.

That is, when diagnosing the failure of the fan, the dishwasher diagnoses the failure of the fan by the predetermined number of failure diagnoses, thereby preset time. The dishwasher may set the failure diagnosis time point based on the preset time.

The dishwasher determines that the fan is in the normal state when it is determined that the re-obtained number of revolutions is higher than or equal to the reference number of revolutions, and ends the diagnosis of the failure of the fan.

The dishwasher determines the failure of the fan (206). When it is determined that the fan is in the normal state, the dishwasher determines whether the present time is the first open time T2*a* (207). When it is determined that the present time is the first open time, the dishwasher controls an operation of the door opening/closing member 170 so that the door 120 is opened (208).

The dishwasher operates the fan 188 so that an air flow is formed around the door 120 (209).

Referring to FIG. 11, the fan of the air curtain may be operated at a time point B1 which is the open time T2*a* of the door. The fan of the air curtain may be operated at a time point B2 which is after the open time T2*a* of the door by a predetermined time.

When the fan of the air curtain operates, the fan sucks the ambient air, and supplies the sucked air to the duct. The air flowing through the duct is discharged to the outside through the discharge ports. At this time, the discharged air lowers the temperature of the high temperature and high humidity air discharged from the washing tub and changes the flow direction.

That is, the dishwasher can form the air curtain for allowing the high temperature and high humidity air inside the washing tub to be discharged to the front of the dishwasher without being discharged to an upper portion of the dishwasher, thereby preventing household appliances and wooden furniture installed around the dishwasher from being damaged by contact with the high temperature and high humidity air, and can minimize damage.

The dishwasher can prevent foreign substances outside from flowing into the dishwasher in advance.

The dishwasher can increase the discharge speed of the air discharged from the washing tub, and can reduce a drying time by operating the air curtain.

Considering the noise of the drain pump, the dishwasher controls the operation of the drainage pump so that the water in the washing tub is drained before opening the door.

The dishwasher determines whether the present time is the first end time of the drying operation (210). When it is determined that the present time is the first end time of the drying operation, the dishwasher outputs the washing completion information of the tableware through the display 162 (211).

The dishwasher can also output the washing completion information of the tableware as sound through the sound output device.

The dishwasher may control the operation of the drainage pump so that the water in the washing tub is drained at a time point after the open time of the door during the drying operation, or may control the operation of the drainage pump so that the water in the washing tub is drained at the end time of the drying operation.

The dishwasher outputs the failure information of the fan through the display when the fan is in the failure state (212). In addition, the dishwasher may output the failure information of the fan as sound through the sound output device.

The failure information of the fan may include an error code.

The dishwasher determines whether the present time is a second open time T2*b* (213). When it is determined that the present time is the second open time, the dishwasher controls the operation of the door opening/closing member 170 so that the door is opened (214).

Figure 13:
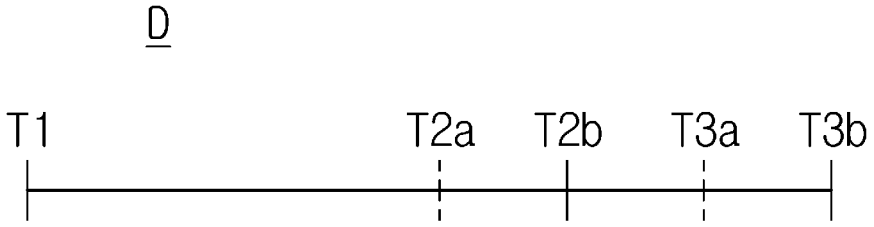
FIG. 13 is a view illustrating a drying operation of the dishwasher when a fan of the dishwasher is failed, in accordance with the embodiment of the present disclosure.

Referring to FIG. 13, a time between the start time of the drying operation and the second open time T2*b* is longer than a time between the start time of the drying operation and the first open time T2*a*.

That is, the dishwasher cannot form the air flow when the fan of the air curtain is in the failure state and the door is opened. Accordingly, a drying function is lowered, and high temperature and high humidity air come into contact with the surrounding furniture.

To prevent this, the dishwasher of the present disclosure delays the opening of the door until the high temperature and high humidity air reaches a target temperature and a target humidity. The target temperature and the target humidity are the temperature and humidity of the air and water vapor in the washing tub to prevent damage to the surrounding furniture.

The dishwasher may further include an outside air detector (not shown) to detect the temperature of the outside air. The dishwasher may adjust the second open time based on the detected temperature of the outside air.

For example, the lower the detected temperature of the outside air, the longer the dishwasher can adjust delay time to be. At this time, the dishwasher can adjust the end time of the drying operation to be longer.

Considering the noise of the drain pump, the dishwasher controls the operation of the drainage pump so that the water in the washing tub is drained before opening the door.

The dishwasher determines whether the present time is a second end time T3*b* of the drying operation (215). When it is determined that the present time is the second end time of the drying operation, the dishwasher outputs the completion information of the tableware through the display 162 (211).

A time between the start time of the drying operation and the second end time T3*b* is longer than a time between the start time of the drying operation and the first end time T3*a*.

The dishwasher may output the washing completion information of the tableware as sound through the sound output device.

The dishwasher may control the operation of the drainage pump so that the water in the washing tub is drained at a time point after the open time of the door during the drying operation, or may control the operation of the drainage pump so that the water in the washing tub is drained at the end time of the drying operation.

The dishwasher may switch the power mode to the standby mode when the drying operation is ended.

The present disclosure describes the configuration in which the latent heat is used to dry the tableware when the drying operation is performed.

As another example of the drying operation, when the drying operation starts, the dishwasher may raise the temperature of the air in the washing tub by using the heater, may remove water of the tableware by spraying the high temperature air, may open the door, and may operate the fan.

Figure 14:
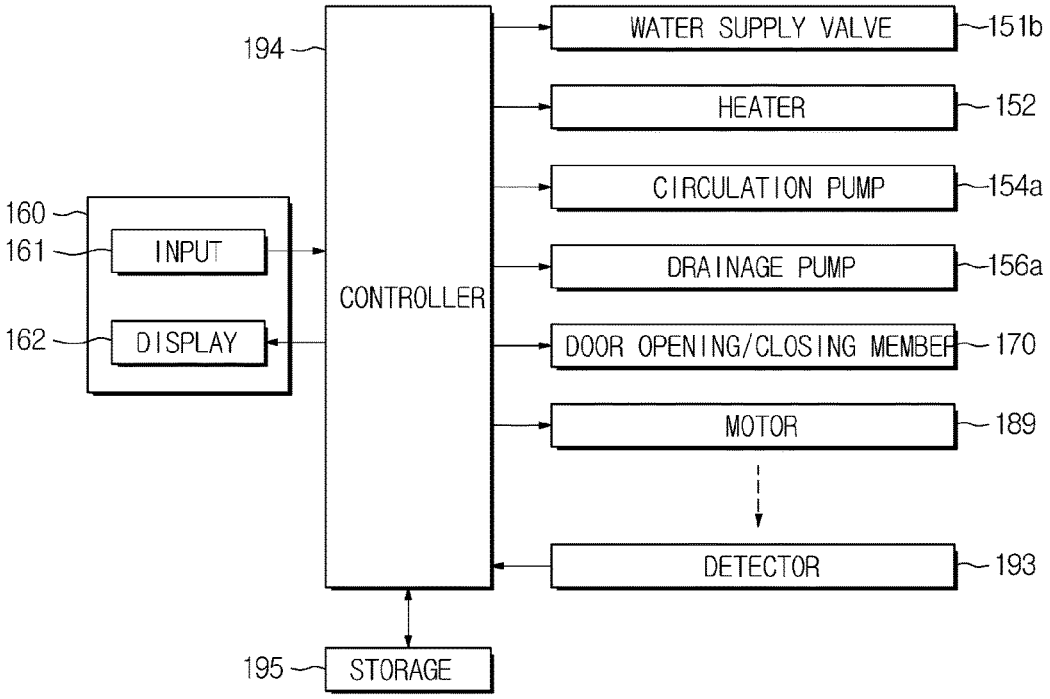
FIG. 14 is a block diagram illustrating a dishwasher in accordance with another embodiment of the present disclosure.

FIG. 14 is a block diagram illustrating a dishwasher in accordance with another embodiment of the present disclosure.

The dishwasher includes a washing assembly 150, a user interface 160, a door opening/closing member 170, an air curtain 180, a drive module 190, and a detector 193.

The washing assembly 150, the user interface 160, the door opening/closing member 170, the air curtain 180, and the detector 193 of the dishwasher in accordance with another embodiment are the same as the washing assembly 150, the user interface 160, the door opening/closing member 170, the air curtain 180, and the detector 193 of the dishwasher in accordance with the previous embodiment. Therefore, a description thereof will be omitted.

The drive module 190 may include a controller 194 to check the washing course input to an input 161, to check operation information of the checked washing course and to control an operation of a water supply valve 151*b*, an operation of a heater 153, an operation of a circulation pump 154*a*, an operation of a drainage pump 156*a* of the washing assembly 150, an operation of the door opening/closing member 170 and an operation of the air curtain 180 based on the checked operation information, and a storage 195 to store various information for controlling an operation of the dishwasher.

The explanation of the same constitution of the drive module 190 of the dishwasher in accordance with previous embodiment among the constitutions of the drive module 190 of the dishwasher in accordance with another embodiment of the present disclosure is omitted.

The controller 194 diagnoses a failure of a fan 188 of the air curtain at a preset time, determines whether to open or close the door during the drying operation based on diagnosis information, and adjusts a time point of an end time of the drying operation during the drying operation based on diagnosis information.

Particularly, the controller 194 controls the operation of the door opening/closing member 170 so that the door is opened at a predetermined open time, controls driving of the motor so that the air flow is formed around the door, controls the operation of the drainage pump 156*a* so that water inside the washing tub is discharged to the outside, and allows the drying operation to end at a predetermined first end time when the fan 188 of the air curtain during the drying operation is in a normal state.

The controller 194 controls the operation of the door opening/closing member 170 to cancel the opening of the door, controls the operation of the drainage pump 156*a* so that water inside the washing tub is discharged to the outside, and allows the drying operation to end at a predetermined third end time when the fan 188 of the air curtain is in a failure state.

That is, the dishwasher controls a closing of the door and an end time of the drying operation so that high temperature and high humidity air inside the washing tub is not discharged to the outside, and waits until the temperature of the air inside the washing tub is lowered.

The failure of the fan 188 of the air curtain includes a failure of a motor 189 to rotate the fan 188.

That is, the controller 194 compares information of the motor detected by the detector 193 with reference information, and diagnoses the failure of the motor based on the compared information.

The detected motor information may include current of the motor, voltage of the motor, number of revolutions of the motor or pulses of the motor.

The number of revolutions of the motor may be indirectly detected by detecting the current of the motor, or directly detected using a physical detector connected to the motor.

The controller 194 may diagnose the failure of the motor 189 by comparing environmental information detected by the detector 193 with reference environmental information.

The detected environmental information may include the pressure, temperature, or rate of flow of air in the housing of the blower.

The storage 195 stores the predetermined open time for opening the door, and stores the predetermined first end time and the predetermined third end time for ending the drying operation.

A time between the start time of the drying operation and the predetermined third end time is longer than a time between the start time of the drying operation and the predetermined first end time.

The predetermined third end time is longer than or equal to the predetermined second end time corresponding to delay of the door opening of previous embodiment of the present disclosure.

The storage 195 may store the operation information of the washing operation, the rinsing operation and the drying operation corresponding to the plurality of laundry courses, respectively.

The storage 195 may store information of a failure diagnosis time point to diagnose the failure of the motor 189 provided in an blower 180*b*.

The information of the failure diagnosis time point includes a time point before the open time of the door during the drying operation.

The storage 195 may store the reference information to diagnose the failure of the motor.

The reference information may include one of a reference current, a reference voltage, a reference number of revolutions, a reference flow rate, a reference pressure, and a reference temperature.

Figure 15:
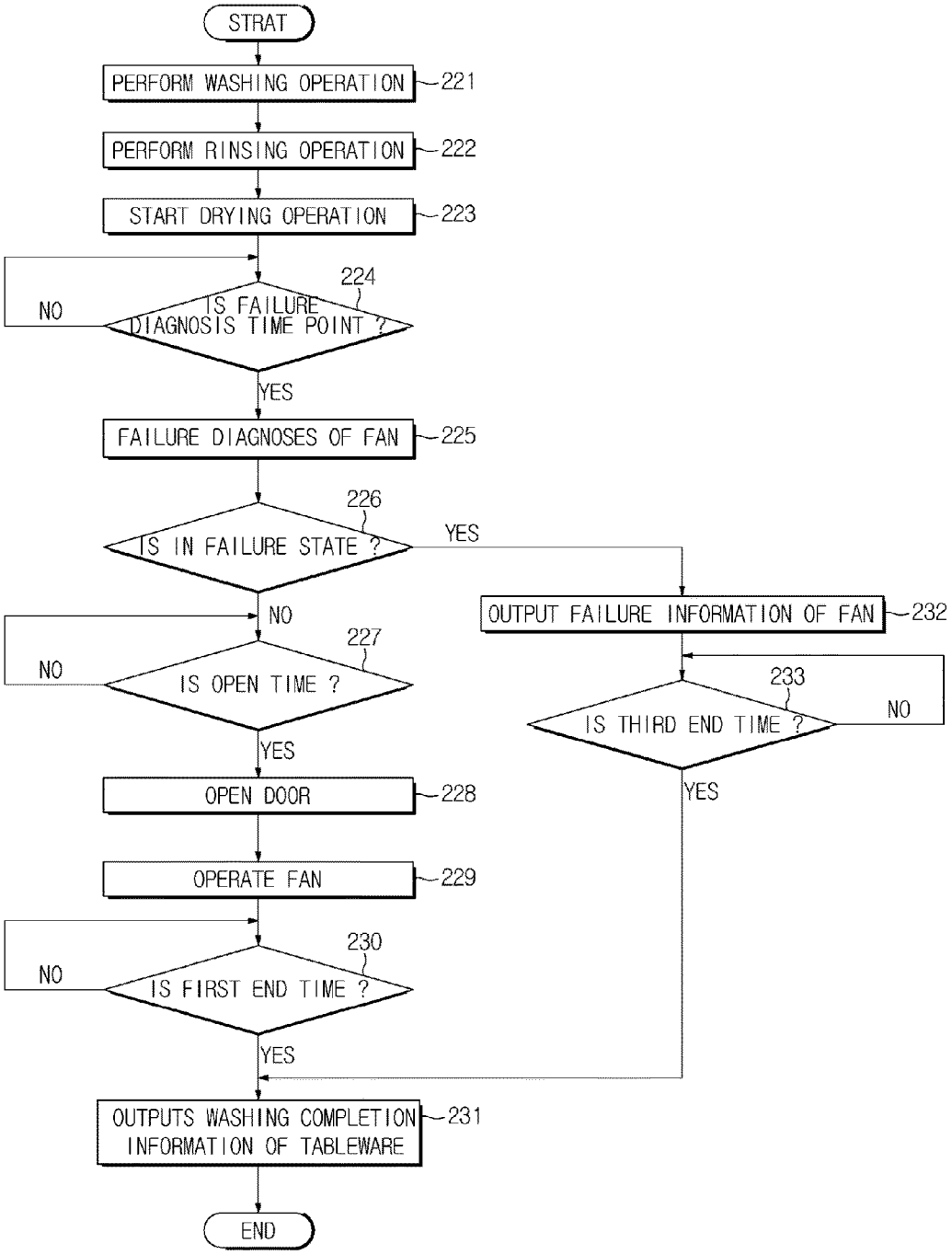
FIG. 15 is a flowchart illustrating a dishwasher in accordance with another embodiment of the present disclosure.

FIG. 15 is a flowchart illustrating a dishwasher in accordance with another embodiment of the present disclosure. This will be described in more detail with reference to FIG. 16.

The dishwasher receives an external power and performs a standby mode when a power on command is input.

The dishwasher cancels the standby mode and checks operation information corresponding to the inputted washing course when the washing course and the start command are inputted to an input 161.

The dishwasher performs the washing operation, the rinsing operation, and the drying operation based on the checked operation information.

Particularly, the dishwasher performs the washing operation (221). When the washing operation is completed, the dishwasher performs the normal rinsing operation of the rinsing operation.

When the normal rinsing operation is completed, the dishwasher performs the high temperature rinsing operation (222). That is, the dishwasher receives the rinse water, controls the operation of the heater so that the temperature of the rinse water is reached to the target temperature, and controls the operation of a circulation pump 154*a* so that the heated high-temperature rinse water is sprayed to the tableware.

When the high temperature rinsing operation is completed, the dishwasher starts the drying operation (223). The dishwasher determines whether the present time point is the failure diagnosis time point of the fan (224), and diagnoses the failure of the fan upon determining that the present time point is the failure diagnosis time point (225).

That is, the dishwasher may diagnose the failure of the fan at a time point before the open time of the door.

The failure diagnosis time point of the dishwasher in accordance with another embodiment is a time point after the drying operation. The failure diagnosis time point may be a time point before the open time of the door. That is, the failure diagnosis time point may be a time point of the washing operation, the rinsing operation and the drying operation.

The dishwasher may determine whether the present time is the predetermined diagnosis time point while performing the washing operation, the rinsing operation and the drying operation.

The diagnosis of the failure of the fan is the same as that of previous embodiment, therefore the description thereof is omitted.

The dishwasher determines whether the fan is in the failure state (226). When it is determined that the fan is in the normal state, the dishwasher determines whether the present time is the open time of the door (227). When it is determined that the present time is an open time T2*a* of the door, the dishwasher controls the operation a door opening/closing member 170 so that the door is opened (228).

The dishwasher operates a fan 188 so that an air flow is formed around a door 120 (229).

The fan of the air curtain may be operated at a time point which is the open time T2*a* of the door. The fan of the air curtain may be operated at a time point which is after the open time T2*a* of the door by a predetermined time.

When the fan of the air curtain operates, the fan sucks ambient air of the fan, and supplies the sucked air to the duct. The air flowing through the duct is discharged to the outside through the discharge ports. At this time, the discharged air lowers the temperature of the high temperature and high humidity air discharged from the washing tub and changes the flow direction.

That is, the dishwasher can form the air curtain for allowing the high temperature and high humidity air inside the washing tub to be discharged to the front of the dishwasher without being discharged to an upper portion of the dishwasher, thereby preventing household appliances and wooden furniture installed around the dishwasher from being damaged by contact with the high temperature and high humidity air, and can minimize damage.

The dishwasher can prevent foreign substances outside from flowing into the dishwasher in advance.

The dishwasher can increase the discharge speed of the air discharged from the washing tub, and can reduce a drying time by operating the air curtain.

Considering the noise of the drain pump, the dishwasher controls the operation of the drainage pump so that the water in the washing tub is drained before opening the door.

The dishwasher determines whether the present time is the first end time of the drying operation (230). When it is determined that the present time is the first end time of the drying operation, the dishwasher washing completion information of the tableware is output through a display 162 (231).

The dishwasher can also output the washing completion information of the tableware as sound through the sound output device.

The dishwasher may control the operation of the drainage pump so that the water in the washing tub is drained at a time point after the open time of the door during the drying operation, or may control the operation of the drainage pump so that the water in the washing tub is drained at the first end time of the drying operation.

The dishwasher outputs the failure information of the fan through the display when the fan is in the failure state (232). In addition, the dishwasher may output the failure information of the fan as sound through the sound output device.

The failure information of the fan may include an error code.

The dishwasher determines whether the present time is a third end time T3*c* of the drying operation (233). When it is determined that the present time is the third end time, the dishwasher washing completion information of the tableware is output through the display 162 (231).

The dishwasher can also output the washing completion information of the tableware as sound through the sound output device.

Figure 16:
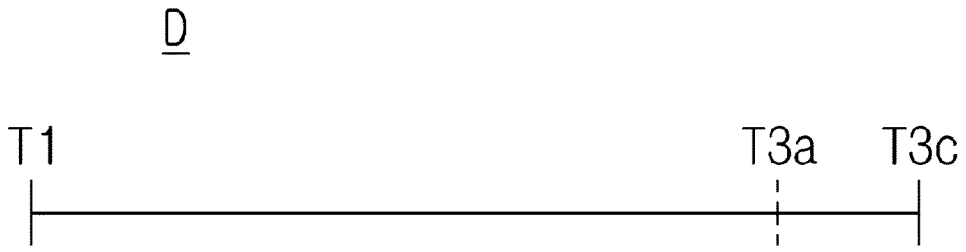
FIG. 16 is a view illustrating a drying operation of the dishwasher in accordance with another embodiment of the present disclosure.

Referring to FIG. 16, a time between the start time of the drying operation and the third end time T3*c* is longer than a time between the start time of the drying operation and a first end time T3*a*.

The predetermined third end time T3*c* is longer than or equal to an end time T3*b* of the drying operation of previous embodiment of the present disclosure.

The dishwasher may control the operation of the drainage pump so that the water in the washing tub is drained during the drying operation, or may control the operation of the drainage pump so that the water in the washing tub is drained at the end time of the drying operation.

The dishwasher may switch the power mode to the standby mode when the drying operation is ended.

The user can identify the completion information of the dishwasher displayed on the display of the dishwasher, and can open the door using the handle of the door.

That is, the dishwasher can be opened by the user after the drying operation is completed.

At this time, the internal temperature of the dishwasher is lower than the temperature of the point at which the door is automatically opened, when the drying operation is completed and the door is opened by the user. Accordingly, the dishwasher can prevent water from condensing in the surrounding furniture by discharged air and water vapor whose temperature is lowered when the door is opened by the user.

The dishwasher may cancel the opening of the door when the drying operation is performed and the fan is in the failure state.

In another embodiment, the dishwasher further includes a test mode for diagnosing a failure of the fan of the air curtain, and may further include an input to select the test mode.

When the test mode is selected through the input, the dishwasher may operate the fan of the air curtain for a predetermined time regardless of the drying operation, may detect information of the fan for the predetermined time, may diagnose the failure of the fan based on the detected information, and may output the diagnosed information.

As is apparent from the above description, a dishwasher and method for controlling the same in accordance with previous embodiment of the present disclosure can allow air to be discharged by operating a fan of an air curtain when a door is opened during a drying operation, thereby lowering the temperature of high temperature and high humidity air discharged from a washing tub and increasing the discharge speed of the air discharged from the washing tub, and can reduce a drying time by increasing a discharge speed of the air discharged from the washing tub.

Further, a dishwasher and method for controlling the same in accordance with another embodiment of the present disclosure can form the air curtain for allowing the high temperature and high humidity air inside the washing tub to be discharged to the front of the dishwasher without being discharged to an upper portion of the dishwasher, thereby preventing household appliances and wooden furniture installed around the dishwasher from being damaged by contact with the high temperature and high humidity air, and can prevent foreign substances outside from flowing into the dishwasher in advance.

Further, a dishwasher and method for controlling the same in accordance with another embodiment of the present disclosure diagnoses the failure of the fan of the air curtain before opening the door, delays the open time of the door or cancels the door opening according to the diagnosis result, thereby discharging the air in the washing tub to the outside of the washing tub after lowering the temperature and humidity of the air in the washing tub.

Further, a dishwasher and method for controlling the same in accordance with another embodiment of the present disclosure can allow a user to easily recognize the failure information and can be quickly handle the failure of the fan by outputting the failure information of the fan of the air curtain.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a main body provided with an opening and a washing tub;

a door configured to be in a first position to open the opening or a second position to close the opening of the main body;

a door opening/closing member configured to open the door to a third position at a predetermined angle to form a gap between the main body and the door in the third position;

an air curtain disposed in the main body, and including:

a duct provided at an upper portion of the washing tub, extending from one side of a front of the main body to another side of the front of the main body and provided with a discharge port, and a fan configured to suck ambient air and to discharge, through the discharge port of the duct, the sucked air toward the gap between the main body and the door;

a detector configured to detect information of the fan; and a controller configured to, based on the information detected by the detector, control the door opening/closing member to open the door to the third position at the predetermined angle to form the gap and control the fan to discharge the sucked air toward an outside of the dishwasher through the gap.

2. The dishwasher according to claim 1, wherein the controller diagnoses a failure of the fan at a time point before the opening of the door to the third position at the predetermined angle and controls the door opening/closing member to delay the opening of the door to the third position at the predetermined angle when the fan is in a failure state.

3. The dishwasher according to claim 2, wherein the time point before the opening of the door to the third position at the predetermined angle includes one of a time point which is a start time of the drying operation, a time point which is after the start time of the drying operation by a first time, a time point which is before the predetermined open time by a second time, and a time point which is before the start time of the drying operation by a third time.

4. The dishwasher according to claim 1, wherein the fan includes a motor;

wherein the controller controls driving of the motor for a predetermined time from a time point before the opening of the door to the third position at the predetermined angle, and diagnoses the failure of the fan based on information detected by the detector while the motor is driving.

5. The dishwasher according to claim 4, wherein the detector includes a current detector to detect a current flowing through the motor;

wherein the controller obtains a number of revolutions of the motor based on the detected current, and diagnoses the failure of the fan based on the obtained number of revolutions.

6. The dishwasher according to claim 1, wherein the detector includes one of a flow rate detector to detect a rate of flow of air around the fan, a pressure detector to detect the pressure around the fan, and a temperature detector to detect the temperature around the fan.

7. The dishwasher according to claim 1, wherein the controller ends the drying operation at a predetermined end time when the fan is in the normal state, and delays the ending of the drying operation when the fan is in the failure state.

8. The dishwasher according to claim 7, further comprising:

a display configured to output failure information of the fan and completion information of the drying operation.

9. The dishwasher according to claim 1, wherein the air curtain includes:

a flow path to flow air blown by the fan, wherein the flow path includes at least one discharge port provided adjacent to the door; and a guide member to guide the flow of air discharged to the outside through the at least one discharge port.

10. A dishwasher comprising:

a main body provided with an opening and a washing tub;

a door configured to be in a first position to open the opening or a second position to close the opening of the main body;

a door opening/closing member configured to open the door to a third position at a predetermined angle to form a gap between the main body and the door in the third position;

an air curtain disposed in the main body, and including:

a duct provided at an upper portion of the washing tub, extending from one side of a front of the main body to another side of the front of the main body and provided with a discharge port, and a fan configured to suck ambient air and to discharge, through the discharge port of the duct, the sucked air toward the gap between the main body and the door;

a detector configured to detect information of the fan; and a controller configured to control the door opening/closing member to open the door to the third position at the predetermined angle to form the gap and control the fan to discharge the sucked air toward an outside of the dishwasher through the gap, based on the information detected by the detector, and to control the door opening/closing member to prevent the opening of the door to the third position at the predetermined angle when the fan is in a failure state.

11. The dishwasher according to claim 10, wherein the controller diagnoses a failure of the fan at a time point before the opening of the door to the third position at the predetermined angle.

12. The dishwasher according to claim 11, wherein the time point before the opening of the door to the third position at the predetermined angle includes one of a time point which is a start time of the drying operation, a time point which is after the start time of the drying operation by a first time, a time point which is before the predetermined open time by a second time, and a time point which before the start time of the drying operation by a third time.

13. The dishwasher according to claim 10, wherein the fan includes a motor;

wherein the controller controls driving of the motor for a predetermined time at a time point before the opening of the door to the third position at the predetermined angle, and diagnoses the failure of the fan based on information detected by the detector while the motor is driving.

14. The dishwasher according to claim 10, wherein the controller ends the drying operation at a predetermined end time when the fan is in the normal state, and delays the ending of the drying operation when the fan is in the failure state.

15. The dishwasher according to claim 14, further comprising:

a display configured to output failure information of the fan and completion information of the drying operation.

16. A method for controlling a dishwasher including a main body provided with an opening, a washing tub, and a door configured to be in a first position to open the opening or a second position to close the opening of the main body, the method comprising:

performing a washing operation, a rinsing operation, and a drying operation when a start command is received;

wherein the performing the washing operation, the rinsing operation and the drying operation, includes:

detecting information of a fan which sucks ambient air and discharges the sucked air, opening the door to a third position at a predetermined angle to form a gap between the main body and the door in the third position, based on the information detected by the detector;

operating a fan to suck the ambient air and to discharge the sucked air toward the gap between the main body and the door, wherein the air is discharged through a duct provided at an upper portion of the washing tub, extending from one side of a front of the main body to another side of the front of the main body and provided with a discharge port.

17. The method according to claim 16, further comprising:

driving of a motor of the fan for a predetermined time at the failure diagnosis time point;

diagnosing a failure of the fan based on the information of the fan while the motor is driving; and delaying the opening of the door to the third position at the predetermined angle when the fan is in a failure state.

18. The method according to claim 16, further comprising:

ending the drying operation at a predetermined end time when the fan is in the normal state; and delaying the ending of the drying operation when the fan is in the failure state.

19. The method according to claim 16, further comprising:

detecting the temperature of the outside when the fan is in the failure state; and setting a delay time to delay the ending of the drying operation based on the detected temperature.

20. The method according to claim 16, wherein the detecting of the information of the fan comprises detecting the information of the fan at a time point before the opening of the door to the third position at the predetermined angle.

* * * * *